US011325080B2

(12) United States Patent
Nikqi et al.

(10) Patent No.: US 11,325,080 B2
(45) Date of Patent: May 10, 2022

(54) MIXER/VACUUM COATER

(71) Applicant: NMBU, Ås (NO)

(72) Inventors: Ismet Nikqi, Ås (NO); Dejan Miladinovic, Ås (NO); Carlos Mauricio Salas Bringas, Drøbak (NO)

(73) Assignee: NMBU, Ås (NO)

( * ) Notice: Subject to any disclaimer, the term of this patent is extended or adjusted under 35 U.S.C. 154(b) by 332 days.

(21) Appl. No.: 16/481,263

(22) PCT Filed: Jan. 8, 2018

(86) PCT No.: PCT/NO2018/050004

§ 371 (c)(1),
(2) Date: Jul. 26, 2019

(87) PCT Pub. No.: WO2018/139932

PCT Pub. Date: Aug. 2, 2018

(65) Prior Publication Data

US 2020/0009518 A1 Jan. 9, 2020

(30) Foreign Application Priority Data

Jan. 27, 2017 (NO) ..... 20170127

(51) Int. Cl.
*B01F 7/04* (2006.01)
*B01F 3/12* (2006.01)
*B01F 7/02* (2006.01)

(52) U.S. Cl.
CPC ..... *B01F 7/047* (2013.01); *B01F 3/1221* (2013.01); *B01F 7/022* (2013.01); *B01F 2215/006* (2013.01)

(58) Field of Classification Search
CPC .... B01F 3/1221; B01F 3/1228; B01F 3/2007; B01F 3/2071; B01F 3/2207; B01F 3/2276;

(Continued)

(56) References Cited

U.S. PATENT DOCUMENTS 2,025,077 A 12/1935 Stewart
3,071,352 A 1/1963 McIntyre
5,161,888 A * 11/1992 Hauck ..... B01F 7/042 366/299
5,645,345 A * 7/1997 O'Neill ..... A01K 5/002 366/186
6,523,988 B1 * 2/2003 Berdais ..... A23N 17/005 366/155.1

(Continued)

FOREIGN PATENT DOCUMENTS

DE 2012294 A1 10/1970
DE 2743552 A1 4/1978

(Continued)

OTHER PUBLICATIONS

PCT/NO2018/050004, International Preliminary Report on Patentability, dated Jan. 2, 2019, 6 pages.
PCT/NO2018/050004, International Search Report and Written Opinion, dated Jun. 13, 2018, 11 pages.

(Continued)

*Primary Examiner* — David L Sorkin
*Assistant Examiner* — Noor F Ahmad
(74) *Attorney, Agent, or Firm* — Kilpatrick Townsend & Stockton LLP

(57) ABSTRACT

A mixer unit comprising a mixing chamber is disclosed. In one example, the mixing chamber comprises a de-agglomerator with a de-agglomeration shaft with de-agglomeration paddles, and a mixer with a mixer shaft with two or more mixing paddles that are arranged for mixing and impelling particles and powders in an upstream direction towards the de-agglomerator, whereby the de-agglomeration shaft is arranged above, and in parallel with said mixer shaft, so that all particles will be impelled towards the de-agglomerator, each time particles are lifted. A first portion of the mixing chamber may also have an inner profile adjacent and curved (Continued)

about an upper part of the de-agglomerator and is arranged to guide particles and powders impelled by the mixing paddles over the de-agglomeration shaft and into a liquid spray.

20 Claims, 7 Drawing Sheets

(58) Field of Classification Search
CPC ..... B01F 7/00; B01F 7/00208; B01F 7/002; B01F 7/0025; B01F 7/00608; B01F 7/00708; B01F 7/02; B01F 7/04; B01F 7/041; B01F 7/048; B01F 7/047; B01F 7/022; B01F 7/027; B01F 7/025; B01F 7/028; B01F 13/10; B01F 13/0016; B01F 13/1002; B01F 13/1013; B01F 13/1022; B01F 15/00779; B01F 15/0085; B01F 15/0087; B01F 15/00909; B01F 15/0201; B01F 15/0203; B01F 2003/1257; B01F 2005/0002; B01F 2005/0091; B01F 2005/0094; B01F 2215/006
USPC ..... 366/197, 242–244, 279, 289, 298–299, 366/309, 332–333; 241/189.1–189.2, 241/190, 198
See application file for complete search history.

(56) References Cited

U.S. PATENT DOCUMENTS

| | | | | |
|---|---|---|---|---|
| 6,551,401 | B1 * | 4/2003 | Winistorfer | B01F 7/00641 118/19 |
| 2018/0036693 | A1 * | 2/2018 | Dubey | A01K 5/002 366/186 |

FOREIGN PATENT DOCUMENTS

| | | |
|---|---|---|
| NO | 156479 B | 6/1987 |
| NO | 164517 B | 7/1990 |

OTHER PUBLICATIONS

NO20170127, Norwegian Search Report, dated Aug. 8, 2017, 2 pages.

* cited by examiner

MIXER/VACUUM COATER

FIELD OF THE INVENTION

The invention relates to a mixing unit. More specific the invention is a single shaft mixing unit using combination of mixing means, de-agglomeration means and spray means for powder materials.

BACKGROUND ART

The Norwegian patent, NO156479B, relates to a mixing machine for mixing particulate materials, for the addition of liquid, especially adhesive substances, to the particles during mixing. The device comprising two opposite rotating shafts with mixing paddles and rotatable throwing roller arranged above and arranged to be in contact with the particles while during mixing throws the particles up and creating a stream of particles into the liquid. The main mixing shaft and additional rollers are driven by their own separate means.

The same applicant as NO156479 holds the Norwegian patent NO164517B which describes an apparatus for mixing particulate matter with liquids with dual agitation shaft, which makes up the mixing zone. The apparatus also comprises a throwing roller at an additional mixing shaft with impellers disposed above and between the rotational axes of the first two shafts for throwing particulate material into a rotatable throwing roller roller. The main mixing shaft and this shafts are driven by their own separate means.

The apparatus above discloses means, which can break up agglomerated particles. They are both provided with dual shaft mixing device and a rotatable throwing roller that disintegrate particles that have been compacting during storage. Common to both the apparatus is that the rotatable throwing roller is placed close to the mixing zone and only the lower part of the rotatable throwing roller is in contact with the mixed particles. Where a liquid spray is added this is placed in a similar position, close to the mixing zone.

U.S. Pat. No. 3,071,352 A discloses a method and apparatus for blending two or more discrete materials.

DE2012294 A1 illustrates a mixing kneader with two stirrer shafts, one above the other. The mixing kneader is especially designed for carrying out thermal processes in liquid, pasty and solid phases.

U.S. Pat. No. 2,025,077 A relates to a mixing and masticating machine, especially for making plastic materials, embedding sticky substances.

DE2743552 A1 describes an apparatus for homogenization of straw cuttings where lye has been applied.

SHORT SUMMARY OF THE INVENTION

The invention is in a first aspect a mixer unit comprising a mixing chamber comprising a de-agglomerator with a de-agglomeration shaft with de-agglomeration means, a mixer with a mixer shaft with two or more mixing paddles, arranged for mixing and impelling particles and powders in an upstream direction towards the de-agglomerator wherein the de-w agglomeration shaft is arranged above, and in parallel with the mixer shaft, so that all particles will be impelled towards the de-agglomerator, each time particles are lifted, further the mixing chamber comprising a first portion of the mixing chamber having an inner profile adjacent and curved about an upper part of the de-agglomerator and arranged to guide particles and powders impelled by the mixing paddles over the de-agglomeration shaft. The mixer comprises one or more spray means adjacent, above, and at a downstream particle flow side of the de-agglomerator, for providing a liquid spray into a downstream flow from the mixing chamber. An advantage is guidance of particles over the de-agglomerator towards the injected spray.

In a second aspect the invention is a mixer unit comprising a mixing chamber comprising a mixer with a mixer shaft, a de-agglomerator with a de-agglomeration shaft with de-agglomeration paddles, wherein the de-agglomeration shaft is arranged above, and in parallel with the mixer shaft, and the mixer comprises first and second end mixing paddles arranged at a first and second inner end of the mixing chamber, respectively, and intermediate mixing paddles arranged between the first and second mixing paddles. Each mixing paddle having a paddle shaft perpendicular arranged at the shaft, each mixing paddle having a mixing paddle blade extending perpendicular to the paddle shaft. The paddle blades extending perpendicular to the paddle shaft at an angle less than 45 degrees and in an embodiment the intermediate paddle blades preferably at an angle less than 20 degree relative the mixer shaft axis for impelling and mixing particles and powders and lifting particles and powders towards the de-agglomerator.

Main advantage by the invention of this second aspect is that the mixer having a mixing shaft with paddles that combines mixing with lifting of particles up to the de-agglomerator.

In the third aspect of the invention is a combination of mixing and vacuum coating technologies deployed in one housing which consists of two separated inspection lids, one for de-agglomerator and one for mixer/vacuum coater. To use differently intended technologies, whether solely mixing with de-agglomerator or mixing and vacuum coating without de-agglomerator, different lids can be mounted. To set the machine in cleaning, filling, emptying or vacuum coating position chain driven components are utilized to rotate the housing in which is placed the mixer shaft.

FIGURE CAPTIONS

The attached figures illustrate some embodiments of the claimed invention.

Figure 7:
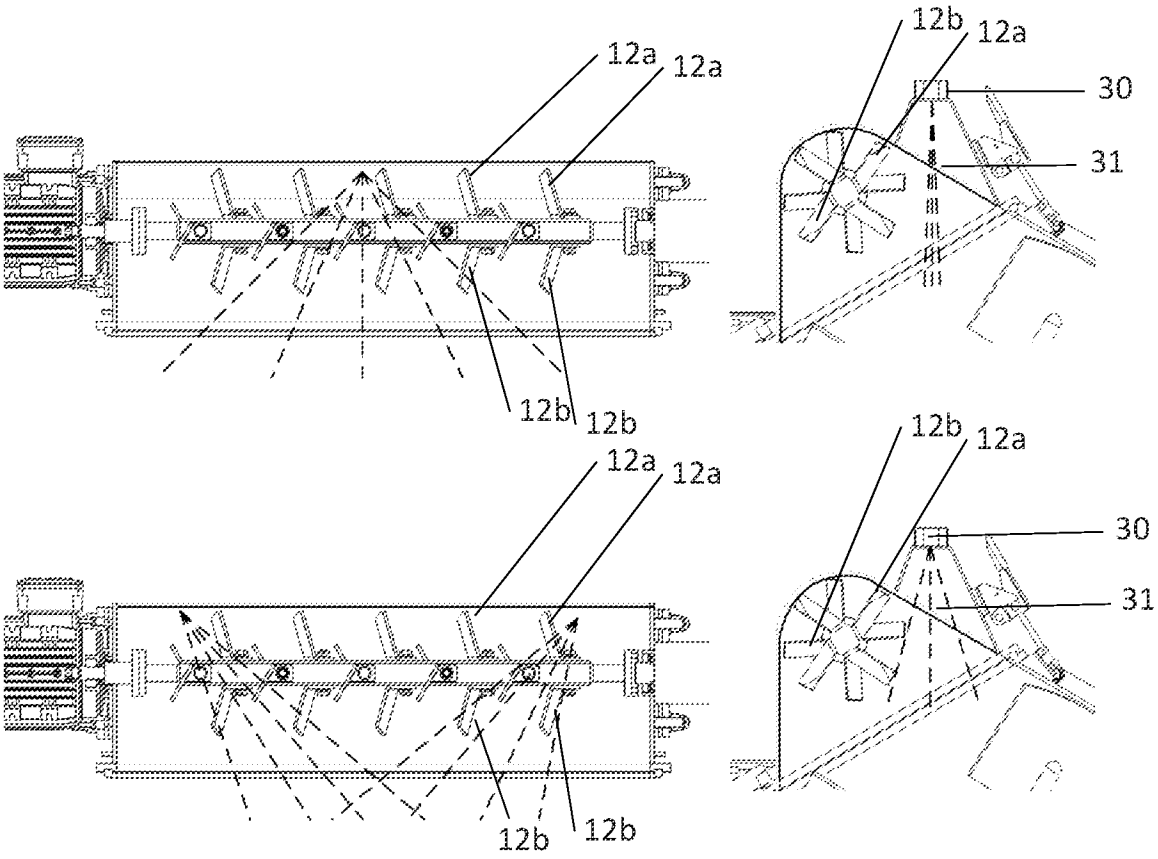

FIG. 7 upper left shows a cross sectional front view of the de-agglomeration portion with spray nozzle and indicated liquid spray.

FIG. 7 upper right is a cross sectional side view of the left figure and illustrates the curtain shape of the liquid spray.

FIG. 7 lower left shows a cross sectional front view of the de-agglomeration portion with two spray nozzle and indicated liquid spray.

FIG. 7 lower right is a cross sectional side view of the left figure and illustrates the broad spread shape of the liquid spray.

EMBODIMENTS OF THE INVENTION

The invention will in the following be described and embodiments of the invention will be explained with reference to the accompanying drawings.

Figure 1:
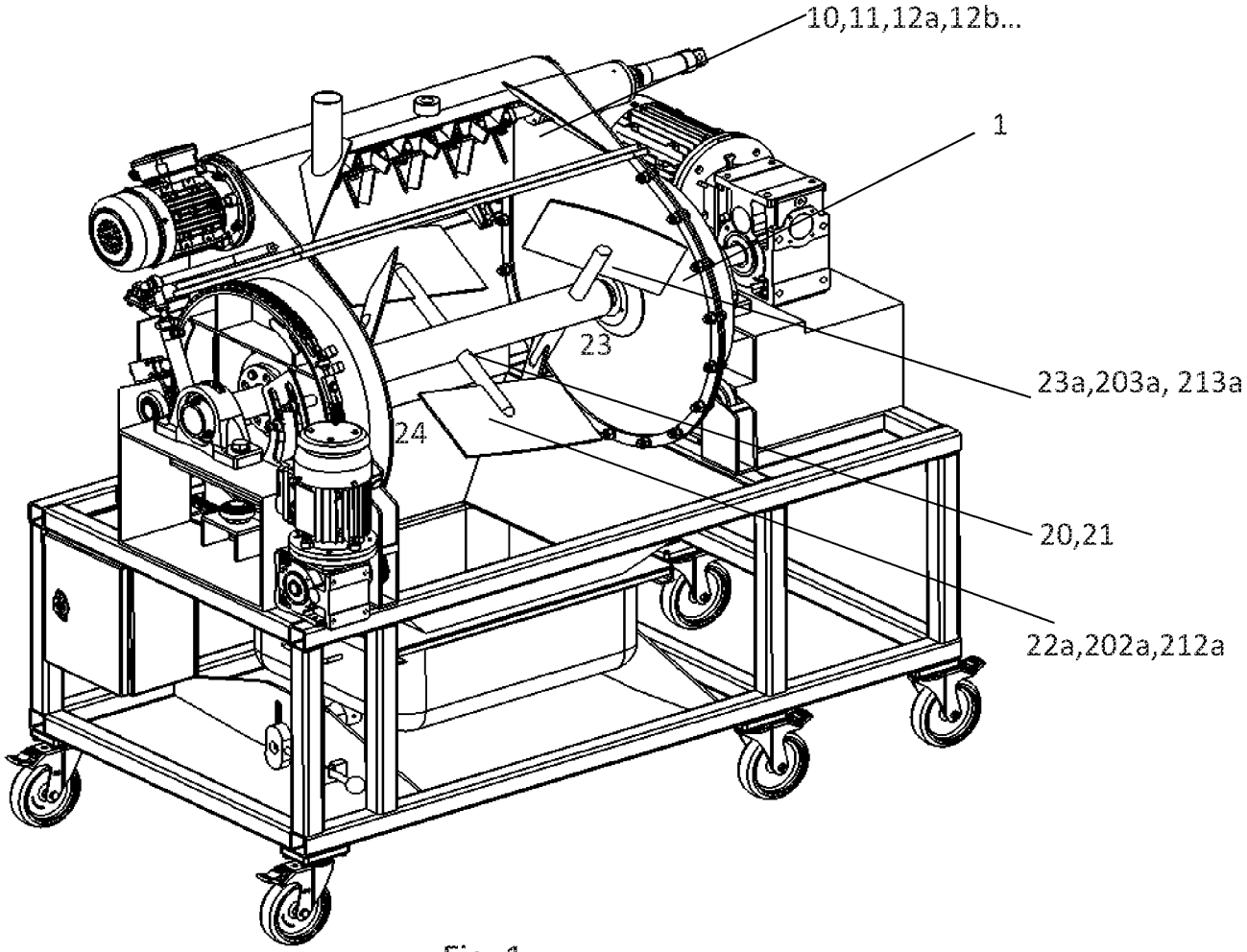
FIG. 1 illustrates an embodiment of the invention where the walls of the chamber (1) is removed in front just to see the inside of the chamber with the mixing and de-agglomerator units.
Figure 2:
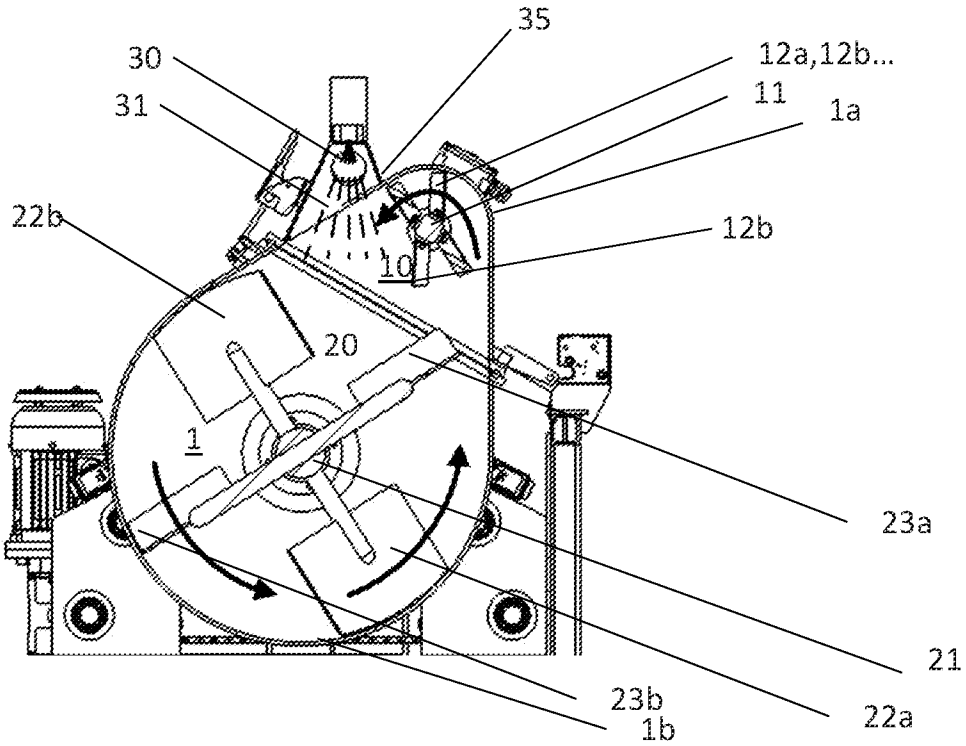
FIG. 2 is a sectional cut of the mixer of FIG. 1 with arrows showing particle flow directions.

FIG. 1 illustrates an embodiment of a first aspect of the invention. The invention is in a first aspect a mixer unit comprising a mixing chamber (1) comprising a de-agglomerator (10) with a de-agglomeration shaft (11) with de-agglomeration means (12*a*, 12*b*, . . . ), a mixer (20) with a mixer shaft (21) with two or more mixing paddles (22*a*, 22*b*, . . . 23*a*, 23*b*, . . . , 24*a*, 24*b*, . . . ), arranged for mixing and impelling particles and powders in an upstream direction (u) towards the de-agglomerator (10) wherein the de-agglomeration shaft (11) is arranged above, and in parallel with the mixer shaft (21), so that All particles will be impelled towards the de-agglomerator, each time particles are lifted, further the mixing chamber (1) comprising a first portion (la) of the mixing chamber (1) having an inner profile adjacent and curved about an upper part of the de-agglomerator (10) and arranged to guide particles and powders impelled by the mixing paddles (22*a*, 22*b*, 23*a*, 23*b*, . . . , 24*a*, 24*b*, . . . ) over the de-agglomeration shaft (11). In an embodiment of the invention the shafts for both the de-agglomerator and the mixer are horizontal arranged and supported in both ends. No synchronization between the shafts is required. This geometry provides for a lifting of particles and powders into a fluidized around the de-agglomerator. The apparatus of the invention can produce a loose and homogeneous blend of cohesive blend.

The portion (1*a*) with a profile that is adjacent and curved about an upper part of the de-agglomerator is not known in the prior art and is favourable with concern to guidance of the particulate matter thrown by the mixer paddles. For prior art mixers the upper part of the de-agglomerator is generally not in use, since a common placing (with reference to NO156479 and NO164517B) only the lower part spins into the mixture of particles and powders provided by the mixing paddles. This may lead to problems related to efficiency of de-agglomeration and mixing with liquid, since the de-agglomerator is largely dependent on the availability of particles and powder in the right level of the chamber to function properly. The invention has a completely different approach to de-agglomeration. Instead of using the lower part of the de-agglomerator, the upper part is used instead. In addition, the guiding profile ensures that particles and powder that is sent towards the de-agglomerator are actually de-agglomerated.

The speed of the main shaft is in function of the volume of the mixer. The minimum speed is estimated by the slowest rotational speed required to impel the particles towards the de-agglomerator. The speed will also depend on particle density and particle size. The speed of the de-agglomerator is chosen according to particle size, density of the particles, and also according to the speed of the incoming particles from the main shaft.

Since there is only use of one shaft mixing impeller the apparatus will be a smaller and more compact production system compared to known systems. Its geometry and design will also make it easy to build, operate, clean and maintain. Development has been to add more mixer shafts in the housing rather than focus on the geometry of the housing and geometry of mixing paddles on a single shaft.

In an embodiment of the invention the mixer has one or more spray means (30) adjacent, above, and at a downstream particle flow side of the de-agglomerator (10), for providing a liquid spray (31) into a downstream flow from the mixing chamber (1). The mixer and the geometry of the first portion (1*a*) of the mixing chamber will then provide for guidance of particles over the de-agglomerator towards the injected spray. The combined work between single shaft mixing elements and de-agglomerating elements will convert heterogeneous powders and particles into a loose, but homogeneous solid-liquid matrix. The de-agglomerating shaft (11), as described, is placed along the mixer and fluidized zone, will deagglomerate aggregated particles and direct them towards another fluidized zone where liquids are sprayed. The deagglomerated materials are in this way quickly transported into another fluidized zone where liquids are applied. The single shaft paddle-mixer de-agglomerator creates an optimal dispersion of liquids in powders and particles. The apparatus will mix powders and particles, also when having different geometries, sizes and cohesive properties due to the combined use of mixing and de-agglomerating elements. The rotational speed of the mixing shaft and the de-agglomerating shaft can be adjusted independently according to the different liquid applications, viscosities, powder size, density and cohesive properties of the particles.

Prior art single-shaft powder mixers generally suffer from an inappropriate dispersion of liquids onto the mixing powders, resulting in agglomeration that ultimately diminishes the mixing capabilities of paddles and hence decrease the mixer performance. To avoid this, the invention uses the following sequence; (i) lifting of particles and powders into a fluidized zone with de-agglomerating elements, (ii) de-agglomeration of powders and particles in the fluidized zone, (iii) directing the fluidized and de-agglomerated powders into another fluidized zone (iv) where liquids are sprayed, (v) the blend then falls into the mixing chamber and the cycle (i-v) continues.

In prior art when the upper part of the de-agglomerator is not in use, since only the lower part spins into the mixture of particles and powders provided by the mixing paddles. This may lead to problems related to efficiency of de-agglomeration and mixing with liquid, since the de-agglomerator is largely dependent on the availability of particles and powder in the right level of the chamber to function properly. When the de-agglomerators lower part spins in the particle mixture it will have a possible throw of particles against the liquid inlet. This is a potential clogging and also further a contamination risk which is undesired. To have open spray means and the right mixture is crucial for food mixtures.

The invention has a completely different approach to de-agglomeration and mixing of liquid into the mixture. As described, instead of using the lower part of the de-agglomerator, the upper part is used instead. In addition, the guiding profile ensures that particles and powder that is sent towards the de-agglomerator are actually de-agglomerated. After de-agglomeration, the profile continues to guide particles towards the liquid spray in a pre-determined pattern, largely independent of the particle type and the amount of mass.

As can be seen, the de-agglomeration process in this case is controlled, and the result is improved quality of the resulting mixture, as well as more efficient mixing.

The mixer according to an embodiment of the invention has a shield (35) arranged between the de-agglomerator (10) and the spray means (30), arranged for preventing particles and powders thrown by the de-agglomeration paddles (12*a*, 12*b*, . . . ) towards the liquid spray (31), to hit the spray means (30). This will further improve the quality of the product mixed and the efficiency of the process.

In an embodiment of the invention the one or more spray means (30) are one or more spray nozzles. In an embodiment the nozzles are curtain spray nozzles and, depending on the width of the mixer one may use one single arranged nozzle for providing a liquid spray in a curtain shape, wherein the curtain shape extends in the longitudinal direction of the de-agglomeration shaft (11). With reference to FIG. 7 the different types of nozzles are discussed: The location of the nozzles at the housing is important to avoid any spraying towards the mixer-housing walls. In order to perform optimal liquid addition by spraying the sprayed particles need to hit only the mixed particles formed as a curtain which are coming from the de-agglomerator, and not the mixing paddles. The sprayed liquids should reach the minimum width which is equal to the intermediate paddle that sends particles towards the de-agglomerator. A flat single-substance nozzle (liquid) and/or a two-substance nozzle (air and liquid) are placed at the housing. The choice of choosing the optimal nozzle is dependable on the viscosity of the added liquid so that every particle, which is impelled from the de-agglomerator, will have the same amount of sprayed liquid adhered to it. The spraying system is consisted of one hollow/cone or flat spray curtain nozzle shown in FIG. 7 upper portion or two hollow/cone or flat spray curtain nozzles shown in FIG. 7 lower portion. Both nozzle types spraying inwards A: Upper portion right, shown in FIG. 7 with the flat spray curtain, shown as the side view and B: Lower portion right, shown in FIG. 7 with the hollow/cone spray, shown as the side view. The spraying system is designed as such so that the de-agglomerator lid and the hollow spray-housing walls will not be hit by the sprayed liquids so that the powder particles will not agglomerate at the walls. The spray set of two nozzles presented in FIG. 7 lower portion do not collide before the sprayed liquid hits the powder particles that are coming from the de-agglomerator, as this might lead to sprayed liquid flow disruption. In case of upscaling the mixer housing the spray housing would need several nozzles set as previously described but in the row.

In an embodiment of the mixer according to the invention the inner profile of the first portion (1*a*) has the form of an arc of a sector with a centre in the intermediate of the de-agglomeration shaft (11) and is perpendicular to the de-agglomeration shaft (11). Along the width of the mixer this will be a tunnel like geometry.

Figure 6:
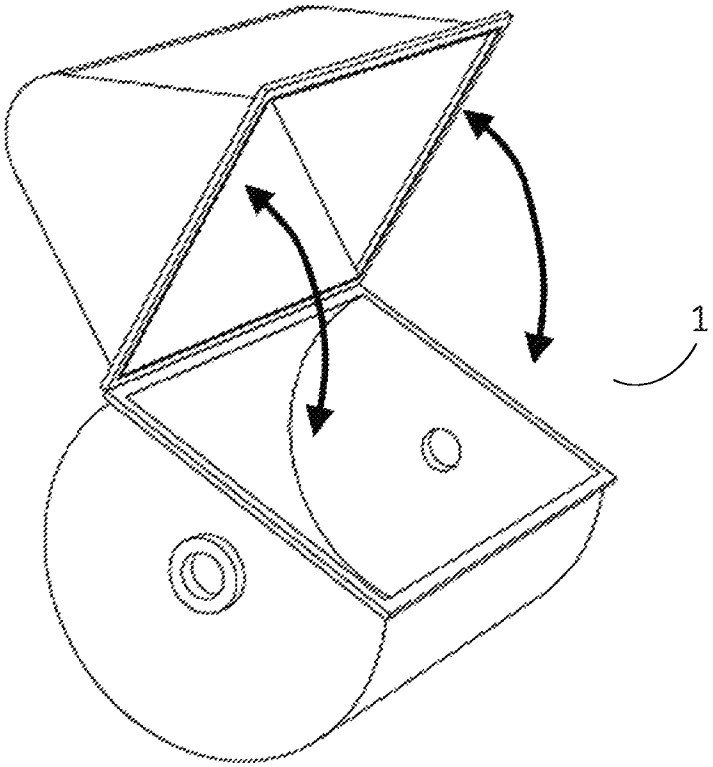
FIG. 6 is a simplified perspective sketch of the chamber (1) with its two parted form.

According to an embodiment of the invention a second portion (1*b*) of the mixing chamber (1) has an inner profile curved upwards and adjacent about a lower part of the mixer (20) and a third portion (1*c*) has a profile extending substantially vertically between the first portion (1*a*) and the second portion (1*b*) to guide the particles and powders in the upstream direction (u). Such an embodiment will then, with reference to FIGS. 1, 2, 4 and 6, have a drum shaped mixing chamber with the mixer (20) and a tunnel like top portion for the de-agglomerator (11), thus this single shaft with paddles, will be disposed along the central axis of the drum shaped mixing chamber and in an embodiment of the invention the mixing chamber (1) is a two part housing wherein the portion comprising the de-agglomerator and spray means constitutes a lid portion. Such setting enables the opening lid to function as an inlet and an outlet of the mixed or vacuum coated materials. The entire mixing housing can rotate about the main mixing shaft, which implies that the driving motor remain stationary when rotating the chamber upside down. For a third aspect of the invention, the top lid may be replaced by a portion without the de-agglomerator and spray means and the mixer may serve as an improved vacuum coater. Thus in the third aspect of the invention the mixer/vacuum coater consists of the main housing without the de-agglomerator but only with the spraying housing. The entire mixing housing can rotate about the main mixing shaft, which implies that the driving motor remain stationary when rotating the chamber upside down. Please see FIG. 6 for an illustration of opening of the chamber.

An embodiment of the mixer (20) comprises a first and second end mixing paddles (23*a*, 23*b*, . . . , 24*a*, 24*b*, . . . ) arranged at a first and second inner end (23, 24) of the mixing chamber (1), respectively, and intermediate mixing paddles (22*a*, 22*b*, . . . ) arranged between the first and second mixing paddles (23*a*, 23*b*, . . . , 24*a*, 24*b*, . . . ), each mixing paddle (22*a*, 22*b*, 23*a*, 23*b*, . . . , 24*a*, 24*b*, . . . ) having a paddle shaft (212*a*, 212*b* . . . , 213*a*, 213*b*, . . . 214*a*, 214*b*, . . . ) perpendicular arranged at the shaft (21), each mixing paddle having a mixing paddle blade (202*a*, 202*b* . . . , 203*a*, 203*b* . . . , 204*a*, 204*b*, . . . ) extending perpendicular to the paddle shaft shaft (212*a*, 212*b* . . . , 213*a*, 213*b*, . . . 214*a*, 214*b*, . . . ) at an angle less than 45-degree relative the mixer shaft (21) for impelling particles and powders towards the de-agglomerator (10).

In an embodiment of the invention the intermediate mixing paddles (22*a*, 22*b*, . . . ) of the mixing paddles (22*a*, 22*b*, 23*a*, 23*b*, . . . , 24*a*, 24*b*, . . . ) are arranged with paddle blades (202*a*, 202*b* . . . ) extending form a paddle axis (PA) of the paddle (22*a*, 22*b*, . . . ) at an angle (a) less than 20-degree relative a shaft axis (SA) of the mixer shaft (21) for impelling particles and powders and lifting particles and powders more directed towards the de-agglomerator (10). Please see FIG. 3.

The mixer paddles in above cited prior art are intended solely for mixing the particles and powder by moving the mass in the direction of the mixer axis.

The mixer axis of the invention has a dual function. In addition to mixing, it is also designed to impel the mass towards the de-agglomerator. This is achieved by the middle mixing paddles that are arranged with a low angle relative the mixer axis. This has the technical effect that the amount and distribution of the mass reaching the de-agglomerator is more predictable. The paddles responsible for impelling the mass from the bottom of the mixing chamber will be much less dependent on the amount of mass in the mixer chamber than in prior art where the de-agglomerator spins into the mass available in the top periphery of the mixing paddles, which may vary considerably. If the level is low, less mass will be de-agglomerated and if the level is high, the de-agglomerator may not be capable of impelling the de-agglomerated mass towards the spray from the nozzle effectively. Thus, the amount, distribution and reliability of the particles and powder that is input to the de-agglomeration process is significantly improved over prior art, and the result is improved quality of the resulting mixture, as well as more efficient mixing.

In an embodiment of the mixer according to the invention the mixer (20) comprises first and second end mixing paddles (23*a*, 23*b*, . . . , 24*a*, 24*b*, . . . ) arranged at a first and second inner end (23, 24) of the mixing chamber (1), respectively, wherein the intermediate mixing paddles (22*a*, 22*b*, . . . ) are arranged between the first and second mixing paddles (23*a*, 23*b*, . . . , 24*a*, 24*b*, . . . ). The rotating shaft (21) consist of two types of paddles, a first and a second paddle, which have the same structural features, and an intermediate paddle, which has structural features that are different from the first and second paddles.

The paddle blades having an outer blade shape, curved, to follow the drum shaped housing (1) inner wall. Thus the first and second mixing paddles (23*a*, 23*b*, . . . , 24*a*, 24*b*, . . . ), due to its alignment relative to the shaft axis (SA), having a curvature different from the intermediate mixing paddles (22*a*, 22*b*, . . . ). The aspect ratio such as height of paddle shaft, width×height geometry and area of paddle blades, should be optimized for specific areas and may vary with the field of use. The blades should run as close to the wall as possible to prevent particles pack up along the inner wall of the housing (1).

According to an embodiment of the invention the intermediate mixing paddles blades (202*a*, 202*b*, . . . ) are arranged in a common plane, to provide alternating sideways impelling of particles and powders towards the de-agglomerator (10). Please see FIG. 3. This provides for a good distribution and efficiency of the de-agglomerator as the particles will be thrown alternating to the two halves of the de-agglomerator length extension. For a third aspect of the invention, the coater, this will not be a prominent feature as the speed will be lower and the particles does not intend to reach a de agglomerating zone.

Figure 3:
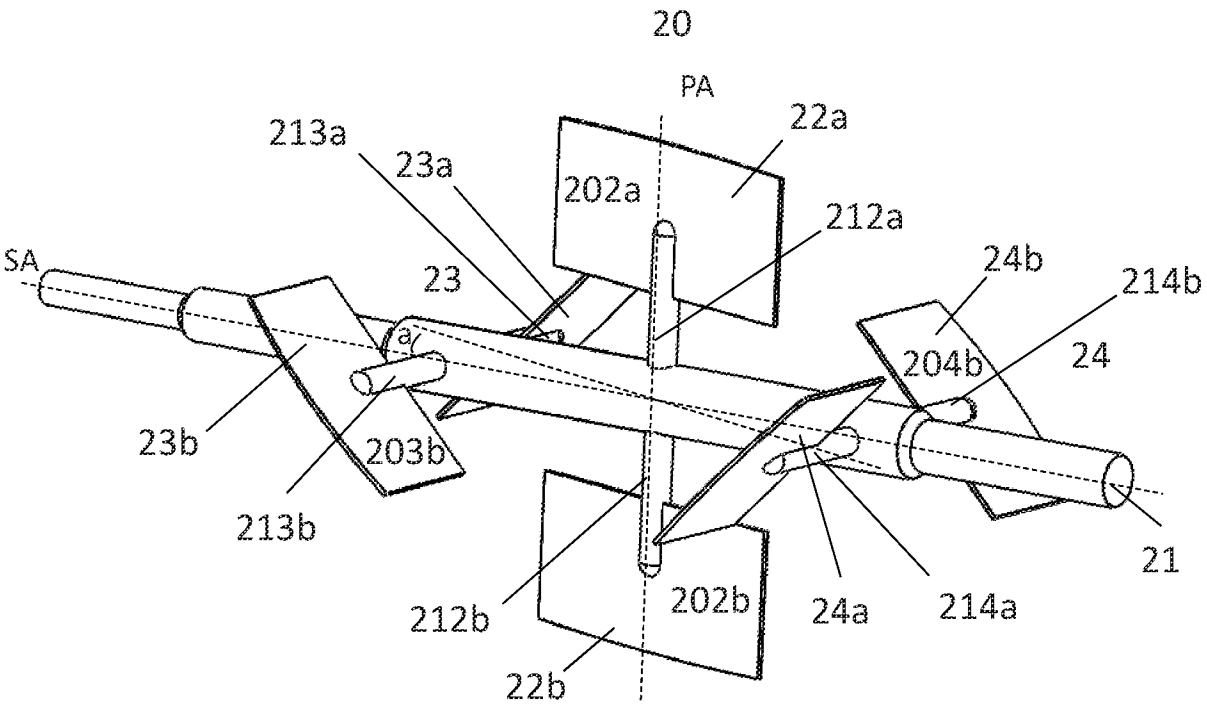
FIG. 3 is a perspective view of the mixing shaft according to an embodiment included in all aspects of the invention, with paddle blades illustrated in planes and angle (a) indication.
Figure 4:
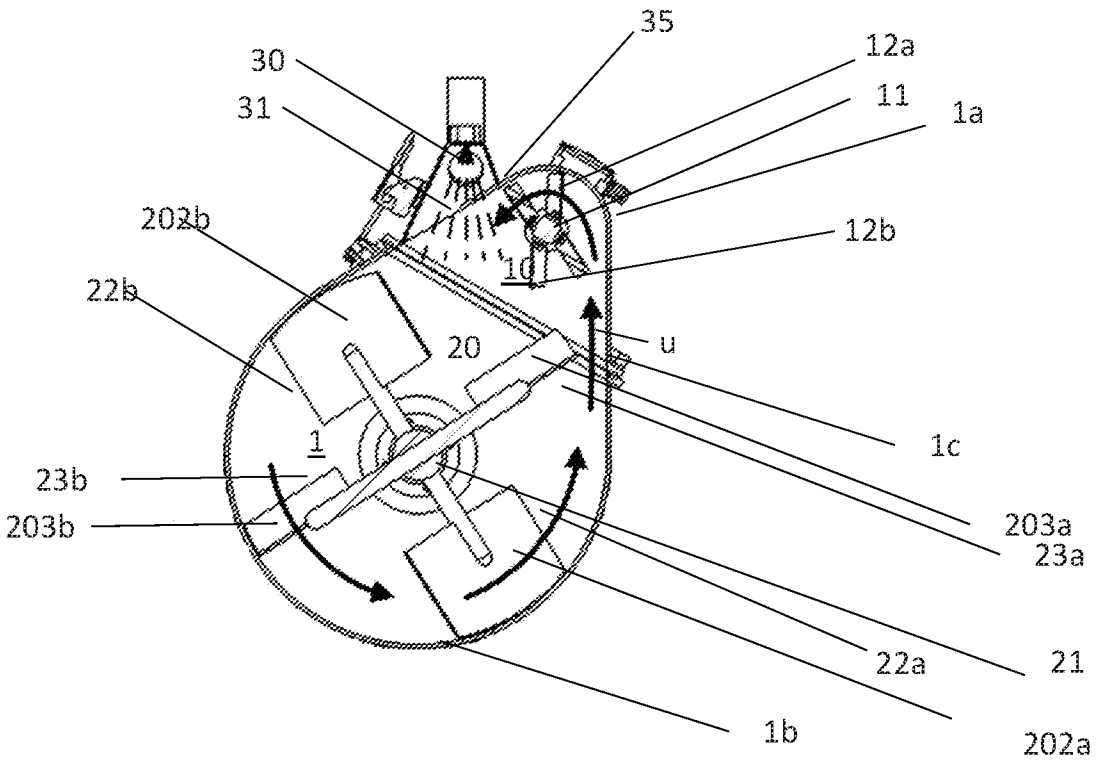
FIG. 4 is a cross sectional view of an embodiment of the invention showing particle flow/throw directions.

Further with reference to FIG. 3, in an embodiment, the mixer has a first first end mixing paddle blade (203*a*) and a first second end mixing paddle blade (204*a*) arranged in parallel planes and on opposite sides of the mixer shaft (21), and a second first end mixing paddle blade (203*b*) and a second second end mixing paddle blade (204*b*) are arranged in parallel planes and on opposite sides of the mixer shaft (1), to move particles and powders towards the intermediate mixing paddles (22*a*, 22*b*, . . . ). This will move the particles in an 8-figured-pattern and assures an excellent mixing of particles of different sizes, qualities, moisture content etc.

Agglomeration means may be of different shapes. It is important to have little areas of edges etc., due to the risk of clogging, lump build up and thus a contamination risk. But it is also important to have god cutting, mixing and throwing properties as well. A compromise of those properties are met in an embodiment of the invention wherein the de-agglomeration means (12*a*, 12*b*, . . . ) are de-agglomeration paddles.

In a second aspect the invention is a mixer unit comprising a mixing chamber (1) comprising a mixer (20) with a mixer shaft (21), a de-agglomerator (10) with a de-agglomeration shaft (11) with de-agglomeration paddles (12*a*, 12*b*, . . . ), wherein the de-agglomeration shaft (11) is arranged above, and in parallel with the mixer shaft (21), and the mixer (20) comprises first and second end mixing paddles (23*a*, 23*b*, . . . 24*a*, 24*b*, . . . ) arranged at a first and second inner end (23, 24) of the mixing chamber (1), respectively, and intermediate mixing paddles (22*a*, 22*b*, . . . ) arranged between the first and second mixing paddles (23*a*, 23*b*, . . . , 24*a*, 24*b*, . . . ), further at least the intermediate set of mixing paddles (22*a*, 22*b*, . . . ), each mixing paddle (22*a*, 22*b*, 23*a*, 23*b*, 24*a*, 24*b*, . . . ) having a paddle shaft (212*a*, 212*b*, 213*a*, 213*b*, 214*a*, 214*b* . . . ) perpendicular arranged at the shaft, each mixing paddle having a mixing paddle blade (202*a*, 202*b*, 203*a*, 203*b*, 204*a*, 204*b* . . . ) extending perpendicular to the paddle shaft. The paddle blades extending perpendicular to the paddle shaft at an angle less than 45 degrees and in an embodiment the intermediate paddle blades preferably at an angle (a) less than 20 degree relative the mixer shaft axis for impelling and mixing particles and powders and lifting particles and powders towards the de-agglomerator (10).

Main advantage by the invention of this second aspect is that the mixer having a mixing shaft with paddles that combines mixing with lifting of particles up to a de-agglomerator.

Figure 5:
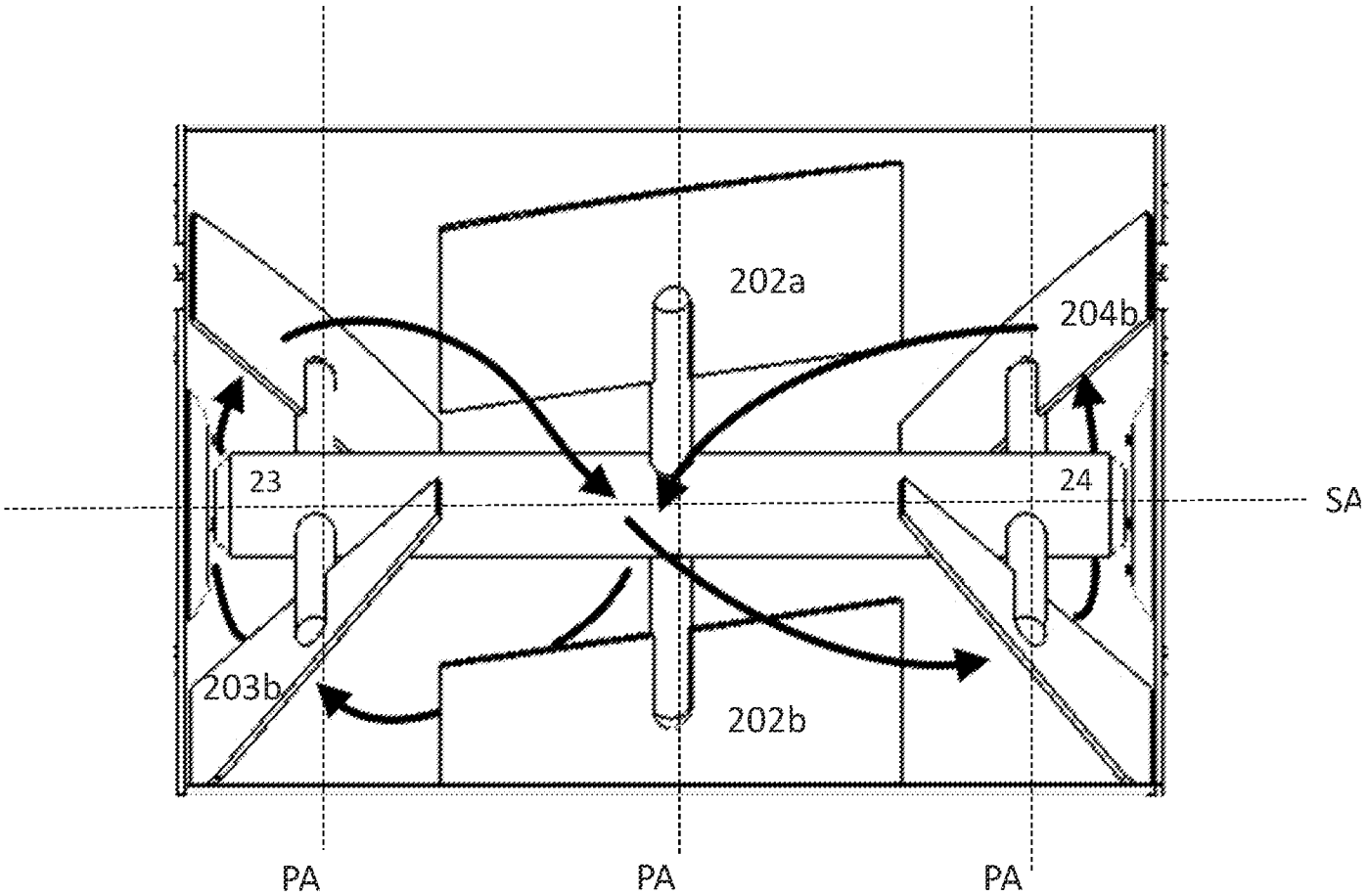
FIG. 5 is a top view into the chamber below the de-agglomerator. Arrows indicating the 8 figure shape of mixing path.

The mixer with the paddle geometry may in a fourth aspect be used as a plain mixer in a housing without de-agglomerator or spray means and act only for mixing and conditioning of the particulate matter mixed. The 8-figured mixing path as illustrated in the FIG. 5 and the lifting effect of the intermediate paddles will contribute to a well mixed and conditioned to desired, set conditions, mixed material.

Embodiments of the different aspects of the invention having similar technical features will have the same advantages to the invention as for the first aspect and vice versa. This will also be applicable to a third and fourth aspect of the invention.

And embodiment of invention according to second aspect may as well comprise intermediate mixing paddles (22*a*, 22*b*, . . . ) that are arranged in a common plane, to provide alternating sideways impelling of particles and powders towards the de-agglomerator (10).

Also an embodiment according to second aspect of the invention comprises a first first end mixing paddle (23*a*) and a first second end mixing paddle (24*a*) are arranged in parallel planes and on opposite sides of the mixer shaft (21), and a second first end mixing paddle (23*b*) and a second second end mixing paddle (24*b*) are arranged in parallel planes and on opposite sides of the mixer shaft (1), to move particles and powders towards the intermediate mixing paddles (22*a*, 22*b*, . . . ).

The second aspect of the invention may also comprise one or more spray means (30) which in an embodiment will be spray nozzles, and for an embodiment the one or more spray means (30) is one or more curtain spray nozzles arranged for providing a liquid spray in a curtain shape, wherein the curtain shape extends in the longitudinal direction of the de-agglomeration shaft (11).

An embodiment of the second aspect of the invention comprises a shield (35) arranged between the de-agglomerator (10) and the spray means (30), arranged for preventing particles and powders thrown by the de-agglomeration paddles (12*a*, 12*b*, . . . ) towards the liquid spray (31), to hit the spray means (30).

An embodiment of a second aspect of the invention having a first first end mixing paddle blade (203*a*) and a first second end mixing paddle blade (204*a*) are arranged in parallel planes and on opposite sides of the mixer shaft (21), and a second first end mixing paddle blade (203*b*) and a second second end mixing paddle blade (204*b*) are arranged in parallel planes and on opposite sides of the mixer shaft (1), to move particles and powders towards the intermediate mixing paddles (22*a*, 22*b*, . . . ).

Embodiments of the second aspect may have chamber portion geometry as for the first aspect i.e. the inner profile of the first portion (1*a*) has the form of an arc of a sector with a centre in the middle of the de-agglomeration shaft (11) and is perpendicular to the de-agglomeration shaft (11), further an embodiment may have a second portion (1*b*) of the mixing chamber (1) has an inner profile curved upwards and adjacent about a lower part of the mixer (20) and a third portion (1*c*) has a profile extending substantially vertically between the first portion (1*a*) and the second portion (1*b*) to guide the particles and powders in the upstream direction (u) and an embodiment may have the mixing chamber (1) as a two part housing wherein the portion comprising the de-agglomerator and spray means constitutes a lid portion.

Above apparatus and systems are described for to be used in a method of mixing food. A single-shaft mixer with a shaft placed in the mixing chamber above, in a dispersing chamber, a de-agglomerating shaft is placed horizontally and parallel to the mixing shaft. The mixing shaft is equipped with paddles and the de-agglomerating shaft equipped with de-agglomerating means. The shafts are connected to two independent electric drive units that can be operated continuously.

The rotational speeds of the shafts are electronically controlled and are independent from each other. The rotation of the mixing shaft and paddles transport particles and powders from the mixing zone, following the trajectory, towards a de-agglomerating zone, following the trajectory. In this zone, agglomerated particles and powders are de-agglomerated. Immediately after the de-agglomeration process, loose particles and powders are directed towards a spraying zone, following trajectory. The solid-liquid blend then return back into the mixing chamber and the cycle continues until the process is stopped. A homogenous dispersion of fluids is possible thanks to de-agglomerated and fluidized powders are suspended at the moment of spraying. Such design and mixing principal gives 4 different possible systems that utilizes the different aspects of the invention:

Batch mixer

Vacuum coater-mixer

Continuous online mixer

Continuous online mixer-conditioner

The invention claimed is:

1. A mixer unit comprising:

a mixing chamber comprising:

a de-agglomerator with a de-agglomeration shaft with de-agglomeration means;

a mixer with a mixer shaft with two or more mixing paddles, arranged for mixing and impelling particles and powders in an upstream direction (u) towards the de-agglomerator, wherein the de-agglomeration shaft is arranged above, and in parallel with the mixer shaft, the mixing chamber further comprising:

a first portion of the mixing chamber having an inner profile adjacent and curved about an upper part of the de-agglomerator and arranged to guide the particles and powders impelled by the two or more mixing paddles over the de-agglomeration shaft, and further one or more spray means that are arranged adjacent, above, and at a downstream particle flow side of the de-agglomerator, for providing a liquid spray into the downstream particle flow in the mixing chamber;

a second portion of the mixing chamber having an inner profile curved upwards and adjacent about a lower part of the mixing chamber; and a third portion of the mixing chamber having a planar profile that extends substantially vertically between the first portion and the second portion to guide the particles and powders in the upstream direction (u).

2. The mixer unit according to claim 1, further comprising:

a shield arranged between the de-agglomerator and the one or more spray means, arranged for preventing the particles and powders thrown by the de-agglomeration means towards the liquid spray, to hit the one or more spray means.

3. The mixer unit according to claim 1, wherein the one or more spray means are one or more spray nozzles.

4. The mixer unit according to claim 3, wherein the one or more spray means are one or more curtain spray nozzles arranged for providing a liquid spray in a curtain shape, wherein the curtain shape extends in a longitudinal direction of the de-agglomeration shaft.

5. The mixer unit according to claim 1, wherein the inner profile of the first portion has a form of an arc of a sector with a centre in a middle of the de-agglomeration shaft and is perpendicular to the de-agglomeration shaft.

6. The mixer unit according to claim 1, wherein the downstream particle flow side of the de-agglomerator is distinct from another side that corresponds to the upper part of the de-agglomerator and is adjacent to the inner profile of the first portion of the mixing chamber.

7. The mixer unit according to claim 1, comprising intermediate mixing paddles of the two or more mixing paddles, arranged with intermediate mixing paddle blades extending from a paddle axis (PA) of an intermediate mixing paddle and the intermediate mixing paddles blades at an angle less than 20-degrees relative a shaft axis (SA) of the mixer shaft for impelling the particles and powders towards the de-agglomerator.

8. The mixer unit according to claim 7, wherein the mixer comprises first and second end mixing paddles arranged at a first and second inner end of the mixing chamber, respectively, wherein the intermediate mixing paddles are arranged between the first and second end mixing paddles.

9. The mixer unit according to claim 7, wherein the intermediate mixing paddle blades are arranged in a common plane, to provide alternating sideways impelling of the particles and powders towards the de-agglomerator.

10. The mixer unit according to claim 7, wherein a first first end mixing paddle blade and a first second end mixing paddle blade are arranged in parallel planes and on opposite sides of the mixer shaft, and a second first end mixing paddle blade and a second second end mixing paddle blade are arranged in parallel planes and on opposite sides of the mixer shaft, to move particles and powders towards the intermediate mixing paddles.

11. The mixer unit according to claim 1, wherein the de-agglomeration means are de-agglomeration paddles.

12. The mixer unit according to claim 1, wherein the mixing chamber is a two part housing wherein the portion comprising the de-agglomerator and the one or more spray means constitutes a lid portion.

13. The mixer unit according to claim 2, wherein the one or more spray means are one or more spray nozzles.

14. The mixer unit according to claim 13, wherein the one or more spray means are one or more curtain spray nozzles arranged for providing a liquid spray in a curtain shape, wherein the curtain shape extends in a longitudinal direction of the de-agglomeration shaft.

15. The mixer unit according to claim 2, wherein the inner profile of the first portion has a form of an arc of a sector with a centre in a middle of the de-agglomeration shaft and is perpendicular to the de-agglomeration shaft.

16. The mixer unit according to claim 2, wherein the shield is arranged between the downstream particle flow side of the de-agglomerator and another side of the de-agglomerator that corresponds to the upper part of the de-agglomerator and is adjacent to the inner profile of the first portion of the mixing chamber.

17. The mixer unit according to claim 8, wherein the intermediate mixing paddle blades are arranged in a common plane, to provide alternating sideways impelling of the particles and powders towards the de-agglomerator.

18. The mixer unit according to claim 8, wherein a first first end mixing paddle blade and a first second end mixing paddle blade are arranged in parallel planes and on opposite sides of the mixer shaft, and a second first end mixing paddle blade and a second second end mixing paddle blade are arranged in parallel planes and on opposite sides of the mixer shaft, to move the particles and powders towards the intermediate mixing paddles.

19. The mixer unit according to claim 2, wherein the de-agglomeration means are de-agglomeration paddles.

20. The mixer unit according to claim 2, wherein the mixing chamber is a two part housing wherein the portion comprising the de-agglomerator and the one or more spray means constitutes a lid portion.

* * * * *